US009996046B2

(12) United States Patent
Oi

(10) Patent No.: US 9,996,046 B2
(45) Date of Patent: Jun. 12, 2018

(54) CLEANING DEVICE AND IMAGE FORMING APPARATUS

(71) Applicant: KYOCERA Document Solutions Inc., Osaka (JP)

(72) Inventor: Hironobu Oi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/582,899

(22) Filed: May 1, 2017

(65) Prior Publication Data

US 2017/0343953 A1 Nov. 30, 2017

(30) Foreign Application Priority Data

May 31, 2016 (JP) ..... 2016-108738

(51) Int. Cl.
*G03G 21/00* (2006.01)
*G03G 21/10* (2006.01)

(52) U.S. Cl.
CPC ..... *G03G 21/0011* (2013.01); *G03G 21/0035* (2013.01); *G03G 21/105* (2013.01)

(58) Field of Classification Search
CPC ..... G03G 21/0011; G03G 21/0035; G03G 21/105
See application file for complete search history.

(56) References Cited

U.S. PATENT DOCUMENTS

| | | | | |
|---|---|---|---|---|
| 8,862,043 | B2 | 10/2014 | Ikebata et al. | |
| 2010/0143011 | A1* | 6/2010 | Tawada | G03G 21/007 399/358 |
| 2015/0050057 | A1* | 2/2015 | Sato | G03G 15/0879 399/358 |
| 2016/0342129 | A1* | 11/2016 | Matsumoto | G03G 21/0011 |
| 2017/0293249 | A1* | 10/2017 | Okura | G03G 21/0011 |

FOREIGN PATENT DOCUMENTS

| | | | |
|---|---|---|---|
| JP | 2006-343371 | A | 12/2006 |
| JP | 2013-092724 | A | 5/2013 |

* cited by examiner

*Primary Examiner* — Rodney Bonnette
(74) *Attorney, Agent, or Firm* — Studebaker & Brackett PC

(57) ABSTRACT

In accordance with a first aspect of the present disclosure, a cleaning device includes a conveying member and a plurality of scraping pieces. The conveying member has a rotating shaft and a spiral blade formed around the rotating shaft. The conveying member is configured to be rotated around an axis to convey a toner removed from an image carrier in a direction of the axis. The plurality of scraping pieces are arranged in the direction of the axis. The plurality of scraping pieces are configured to be turnable so as to alternately come into contact with the rotating shaft and the spiral blade to scrape the toner adhered on the rotating shaft. A width of the scraping piece in the direction of the axis is equal to or below ½ of a gap between the adjacently arranged scraping pieces in the direction of the axis.

4 Claims, 12 Drawing Sheets

CLEANING DEVICE AND IMAGE FORMING APPARATUS

INCORPORATION BY REFERENCE

This application is based on and claims the benefit of priority from Japanese Patent application No. 2016-108738 filed on May 31, 2016, which is incorporated by reference in its entirety.

BACKGROUND

The present disclosure relates to a cleaning device which removes a toner from an image carrier and an image forming apparatus including the cleaning device.

In an image forming apparatus, such as a copying machine and a printer, an electrostatic latent image formed on a photosensitive drum is developed into a toner image, the toner image is transferred via an intermediate transferring body or directly on a recording medium and then fixed on the recording medium. The toner remained on the photosensitive drum after the toner image is transferred on the recording medium is removed by a cleaning device. The cleaning device includes a toner removing member and a conveying screw. The toner removing member comes into contact with the photosensitive drum and removes the residual toner from a surface of the photosensitive drum. The conveying screw conveys the removed residual toner (a waste toner) to a waste toner container or the like.

In such a cleaning device, depending on an surrounding environment (temperature, humidity or the others), the waste toner firmly adheres on a circumferential face of a rotating shaft of the conveying screw. This causes increasing in the diameter of the rotating shaft and reduces a conveying ability of the conveying screw. Especially, because of its low flowability, the waste toner tends to accumulate on the circumferential face of the rotating shaft.

SUMMARY

In accordance with a first aspect of the present disclosure, a cleaning device includes a conveying member and a plurality of scraping pieces. The conveying member has a rotating shaft and a spiral blade formed around the rotating shaft. The conveying member is configured to be rotated around an axis to convey a toner removed from an image carrier in a direction of the axis. The plurality of scraping pieces are arranged in the direction of the axis. The plurality of scraping pieces are configured to be turnable so as to alternately come into contact with the rotating shaft and the spiral blade to scrape the toner adhered on the rotating shaft. A width of the scraping piece in the direction of the axis is equal to or below ½ of a gap between the adjacently arranged scraping pieces in the direction of the axis.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a cleaning device according to an embodiment of the present disclosure will be described.

Figure 1:
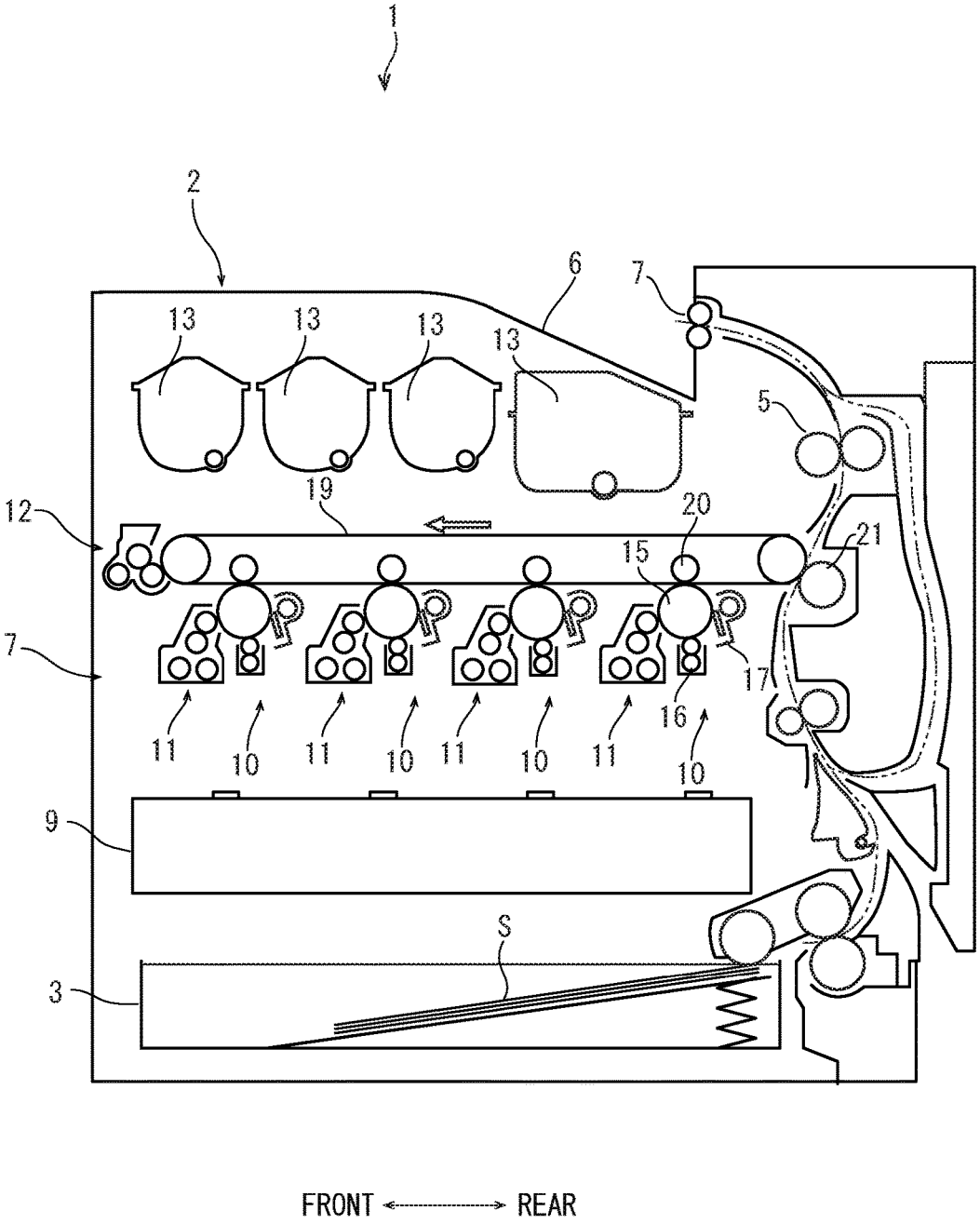
FIG. 1 is a view schematically showing a color printer according to an embodiment of the present disclosure.

With reference to FIG. 1, an entire structure of a color printer 1 as an image forming apparatus will be described. FIG. 1 is a view schematically showing the color printer. In the following descriptions, a left side of the paper plan of FIG. 1 is set as a front side of the color printer 1, and left and right directions are based on a direction in which the color printer 1 is seen from the front side.

An apparatus main body 2 of the color printer 1 is provided with a sheet feeding cassette 3, an image forming part 4, a fixing device 5 and an ejection device 7. The sheet feeding cassette 3 stores sheets S. The image forming part 4 is detachably attached to the apparatus main body 2 and forms a full color toner image on the sheet S. The fixing device 5 fixes the toner image on the sheet S. The ejection device 7 ejects the sheet S on which the toner image is fixed to an ejection tray 6. The sheet S is fed from the sheet feeding cassette 3. Then, after a full color toner image is formed on the sheet S at the image forming part 4, the full color toner image is fixed on the sheet S by the fixing device 5 and then the sheet S is ejected to the ejection tray 6 by the ejection device 7.

The image forming part 4 includes an exposing device 9, four drum units 10 provided corresponding to four colors (yellow, magenta, cyan and black) of toner, four development units 11 provided corresponding to the four colors of the toner, an intermediate transferring unit 12 and four toner containers 13 each containing the toner of each color.

The drum unit 10 includes a photosensitive drum 15 as a rotatable image carrier on which an electrostatic latent image is formed. The drum unit 10 further includes a charging device 16 configured to charge the photosensitive drum 15 and a cleaning device 17 configured to remove the toner remained on the photosensitive drum 15. The charging device 16 and the cleaning device 17 are arranged around the photosensitive drum 15 along a rotating direction of the photosensitive drum 15.

The development unit 11 includes a development device configured to develop the electrostatic latent image formed in the photosensitive drum 15 into the toner image.

The intermediate transferring unit 12 includes an endless intermediate transferring belt 19 and four first transferring rollers 20 disposed in an inner space of the intermediate transferring belt. On opposing to one end of the intermediate transferring belt 19, a second transferring roller 21 is provided on the apparatus main body 2.

In the image forming part 4, after the charging device 16 charges the photosensitive drum 15 of the drum unit 10, the exposing device 9 exposes the photosensitive drum 15 according to an image data to form the electrostatic latent image on the photosensitive drum 15. The electrostatic latent image is developed into the toner image by the development device of the development unit 11. The toner image is transferred on the intermediate transferring belt 19 from the photosensitive drum 15 by the first transferring rollers 20 of the intermediate transferring unit 12. The four toner images formed by the four drum units 10 and the four development units 11 are transferred on the intermediate transferring belt 19 to form a full color toner image on the intermediate transferring belt 19. The full color toner image is transferred on the sheet S from the intermediate transferring belt 19 by the second transferring roller 21. The toner remained on the photosensitive drum 51 is removed by the cleaning device 53. The toner remained on the photosensitive drum 15 is removed by the cleaning device 17. The sheet on which the full color toner image is transferred is conveyed to the fixing device 5, and the full color toner image is fixed on the sheet S. Then, the sheet S is ejected by the ejection device 7 on the ejection tray 6.

Figure 2:
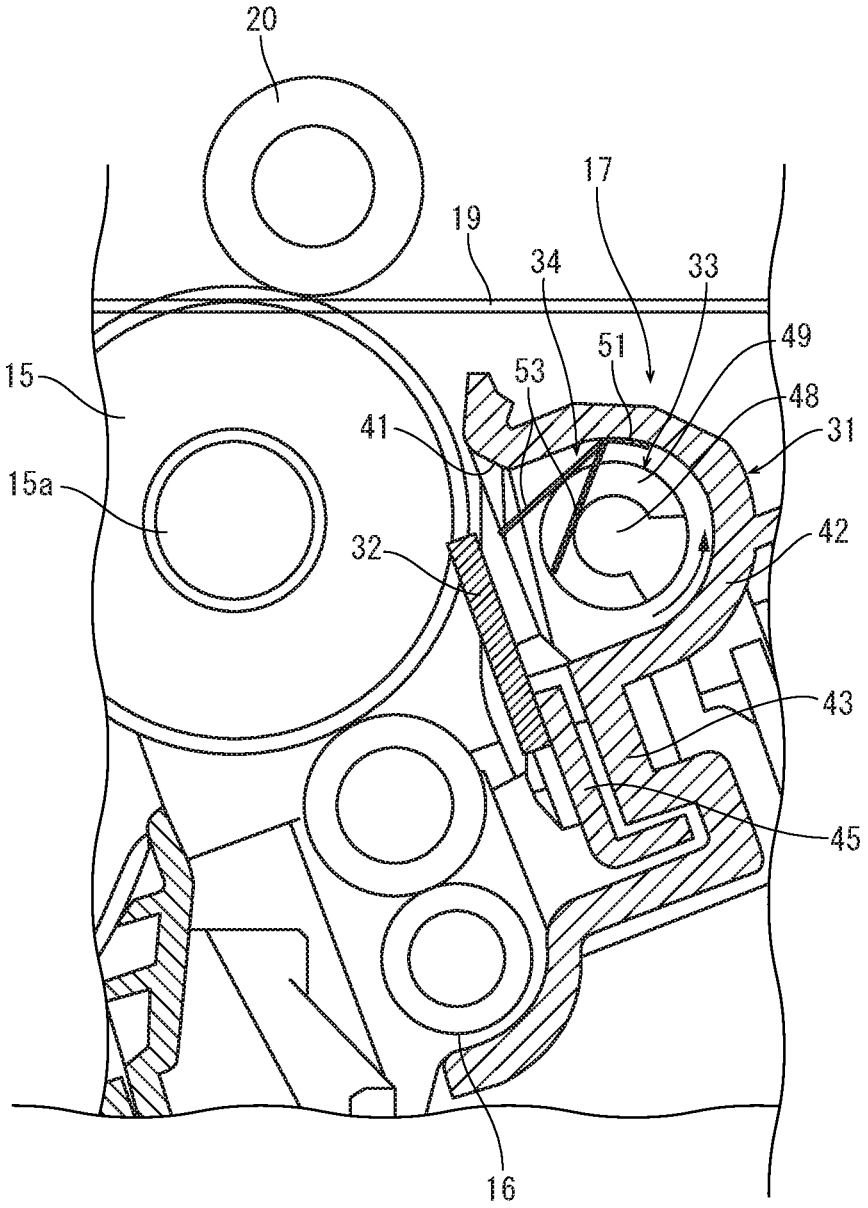
FIG. 2 is a sectional view showing a cleaning device of the color printer according to the embodiment of the present disclosure.
Figure 3:
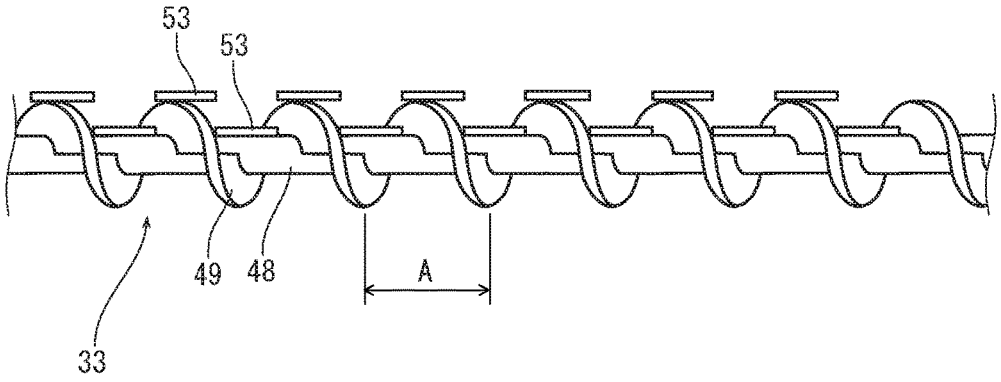
FIG. 3 is a view schematically showing a contact state where scraping pieces of a scraping member of a first embodiment come into contact with a conveying screw, in the cleaning device according to the embodiment of the present disclosure.

Next, with reference to FIG. 2 and FIG. 3, the cleaning device 17 will be described. FIG. 2 is a sectional view showing the cleaning device and FIG. 3 is a view schematically showing contact portions where scraping pieces come into contact with a conveying screw.

The cleaning device 17 includes a housing 31, a cleaning blade 32, a conveying screw 33 and a scraping member 34. The housing 31 is provided along an axis direction of a rotating shaft 15*a* of the photosensitive drum 15. The cleaning blade 32 is an example as a toner removing member configured to remove the toner from the surface of the photosensitive drum 15. The conveying screw 33 is an example as a conveying member configured to convey the removed toner. The scraping member 34 is provided along the conveying screw 33.

The housing 31 has a storage recess 42 having a U-shaped cross section and a supporting part 43 provided below the storage recess 42. The storage recess 42 has an opening 41 formed along the axis direction of the rotating shaft 15*a* of the photosensitive drum 15. On one end portion of a bottom wall of the storage recess 42 in the axis direction, a communication port (not shown) is formed so as to communicate with a toner collection container (not shown). The supporting part 43 extends downward from a lower edge of the opening 41 of the storage recess 42. The housing 31 is supported such that the opening 41 faces the surface of the photosensitive drum 15 in a slightly downward inclined posture.

The cleaning blade 32 is a plate like member long in the axis direction of the rotating shaft 15*a* of the photosensitive drum 15, and supported by a mounting member 45 having a L-shaped cross section. The mounting member 45 is supported by the supporting part 43 of the housing 31 such that the cleaning blade 32 covers almost of a lower half of the opening 41 of the housing 31 and a distal edge of the cleaning blade 32 comes into contact with the surface of the photosensitive drum 15 in a counter direction opposing to the rotating direction of the photosensitive drum 15. The cleaning blade 32 is made of resin, such as polyurethane or PET, for example.

The conveying screw 33 includes a rotating shaft 48 and a spiral blade 49 formed around the rotating shaft 48 spirally, as shown in FIG. 3. As shown in FIG. 2, the conveying screw 33 is supported in the storage recess 42 of the housing 31 such that an uppermost portion of the spiral blade 49 is positioned above a contact portion where the cleaning blade 32 comes into contact with the photosensitive drum 15. The conveying screw 33 rotates in the counterclockwise direction in FIG. 2. That is, the conveying screw 33 rotates in a direction toward the distal edge of the cleaning blade 32 from the upper side. A gap (a pitch) of the spiral blades 49 is set to A.

Figure 4A:
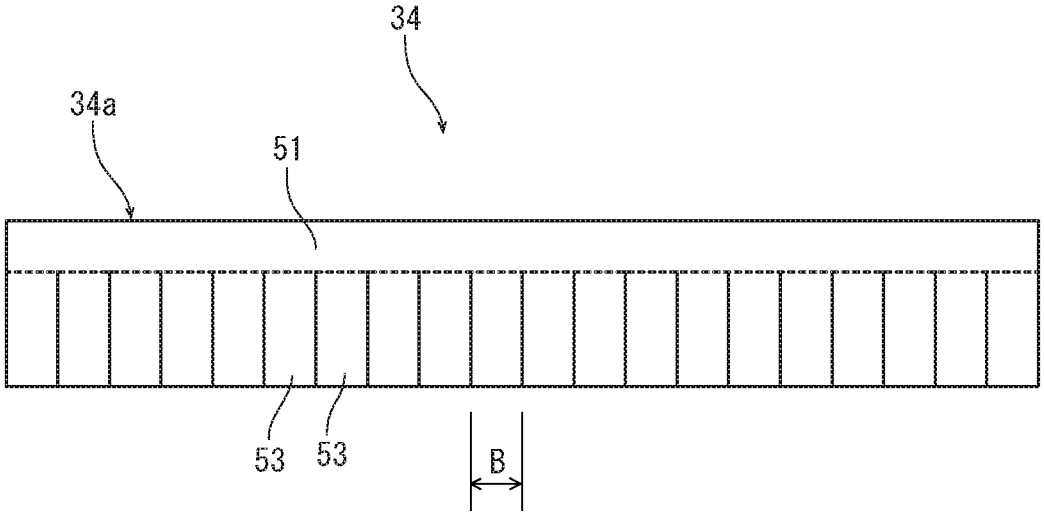
FIG. 4A is a plan view showing a sheet member from which the scraping member of the first embodiment is formed, in the cleaning device according to the embodiment of the present disclosure.
Figure 4B:
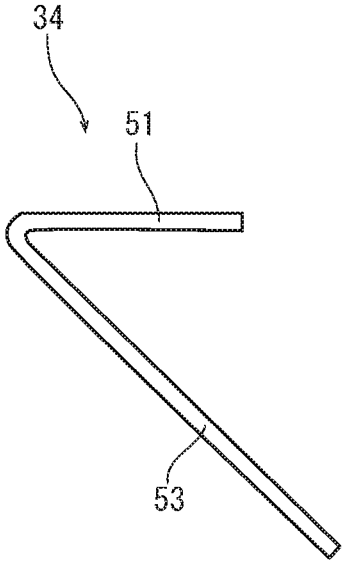
FIG. 4B is a side view showing the scraping member of the first embodiment, in the cleaning device according to the embodiment of the present disclosure.

The scraping member 34 according to a first embodiment will be described with reference to FIG. 4A and FIG. 4B. FIG. 4A is a plan view showing a sheet member and FIG. 4B is a side view showing the scraping member. As shown in FIG. 4A, the scraping member 34 is formed by a rectangular shaped sheet member 34*a* long in the axis direction of the rotating shaft 48 of the conveying screw 33. The scraping member 34 has a fixing part 51 provided along the axis direction and a plurality of scraping pieces 53 protruding from the fixing part 51 in a direction perpendicular to the axis direction. As shown in FIG. 4B, the plurality of scraping pieces 53 are bent with respect to the fixing part 51 at an acute angle. The sheet member 34*a* is made of PET sheet, for example.

As shown in FIG. 4A, each scraping piece 53 is formed into a rectangular shape, and has a width B equal to ½ of the pitch A of the spiral blade 49 of the conveying screw 33 (B=A/2). In addition, there is no gap between the scraping pieces 53 adjacently arranged in the axis direction. In this way, the plurality of scraping pieces 53 are formed by cutting the sheet member 34*a* at intervals equal to the width B.

As shown in FIG. 2, the fixing part 51 of the scraping member 34 is fixed to an upper portion of an inner circumferential face of the storage recess 42 of the housing 31. Each scraping piece 53 comes into contact with the conveying screw 33 in a forward direction to the rotating direction of the conveying screw 33. Because the scraping piece 53 has a width equal to ½ of the pitch A of the spiral blade 49, as shown in FIG. 3, the scraping pieces 53 always come into contact with the outer circumferential face of the rotating shaft 48 through a space between the adjacent spiral blades 49. In addition, the scraping pieces 53 on both sides of the above scraping piece 53 come into contact with outer circumferential faces of the spiral blades 49. In this way, the plurality of scraping pieces 53 alternately come into contact with the outer circumferential face of the rotating shaft 48 and the outer circumferential face of the spiral blade 49.

Furthermore, when the scraping piece 53 comes into contact with the conveying screw 33, the scraping piece 53 is elastically deformed from an original posture where it is bent with respect to the fixing part 51 at an acute angle into a deformed posture where it is bent with respect to the fixing part 51 at an obtuse angle. Accordingly, the scraping piece 53 elastically come into contact with the outer circumferential face of the rotating shaft 48 and the outer circumferential face of the spiral blade 49.

In addition, as shown in FIG. 2, when the scraping piece 53 comes into contact with the outer circumferential face of the spiral blade 49, the scraping piece 53 extends in a tangential direction of the outer circumferential face of the spiral blade 49 over the most protruded outer circumferential face on the side of the cleaning blade 32 to near a tip edge (a blade edge portion) of the cleaning blade 32.

A cleaning operation of the cleaning device 17 having the above described configuration will be described. The toner (a waste toner) remained on the photosensitive drum 15 after the toner image is transferred from the photosensitive drum 15 to the intermediate transferring belt 19 is scraped by the cleaning blade 32 into the storage recess 42. The scraped waste toner is conveyed by the conveying screw 33 and collected into the waste toner collection container through the communication port.

On rotating the conveying screw 33, each scraping piece 53 of the scraping member 34 is turned so as to alternately come into contact with the outer circumferential face of the rotating shaft 48 and the outer circumferential face of the spiral blade 49. That is, as the conveying screw 33 is rotated, the scraping piece 53 comes into contact with the rotating shaft 48 between the adjacent spiral blades 49, is separated from the rotating shaft 48, runs on the spiral blade 49, is separated from the spiral blade 49 and then comes into contact with the rotating shaft 48. In addition, the adjacently arranged scraping pieces 53 are turned in opposing directions each other. When the scraping piece 53 comes into contact with the outer circumferential face of the rotating shaft 48 on the front side of the rotating direction of the rotating shaft 48, the waste toner firmly adhered on the outer circumferential face is blocked and scraped by the scraping piece 53. The scraped waste toner is fallen into the storage recess 42. In addition, the scraping piece 53 elastically comes into contact with the outer circumferential face of the rotating shaft 48 to generate vibration. The generated vibration can provide an effect for preventing the adhesion of the waste toner to the rotating shaft 48. Furthermore, because the scraping piece 53 alternately comes into contact with the rotating shaft 48 and the spiral blade 49, it becomes possible to crush a lump of the toner accumulated between the spiral blades 49.

As described above, in the cleaning device 17 of the present disclosure, because the scraping piece 53 has a width equal to ½ of the pitch of the spiral blade 49 of the conveying screw 33, the scraping pieces 53 always come into contact with the rotating shaft 48. That is, one half portion of the rotating shaft 48 between the spiral blades 49 is formed with the spiral blade 49 while the other half portion is not formed with the spiral blade 49. Accordingly, when the scraping piece 53 is formed so as to have a width equal to ½ of the pitch of the spiral blades 49, the scraping piece 53 always comes into contact with the rotating shaft 48. As the width of the scraping piece 53 becomes narrower, it becomes possible to make the scraping piece 53 come into contact with the rotating shaft 48 at finer intervals in the axis direction of the rotating shaft 48. However, if the width of the scraping piece 53 becomes narrower, the scraping piece 53 may be decreased in rigidity. Accordingly, a width of the scraping piece 53 is preferably equal to or below ½ of the pitch of the spiral blade 49 of the conveying screw 33.

Furthermore, because there is no gap between the adjacently arranged scraping pieces 53, when the waste toner is conveyed in the rotating direction of the conveying screw 33, the waste toner is blocked by the scraping piece 53 and hardly reaches the blade edge portion. Accordingly, it becomes possible to prevent the waste toner from being accumulated on the blade edge portion.

In addition, because tip end portions of the adjacently arranged scraping pieces 53 are alternately turned at the blade edge portion, the lump of the toner accumulated on the blade edge portion is crushed to prevent the toner accumulation. Especially, because the tip end portions of the adjacently arranged scraping pieces 53 are turned within a wide range, the effect for crushing the lump of the waste toner can be more improved.

As described above, it becomes possible to prevent the increasing in the diameter of the rotating shaft 48 of the conveying screw 33 and then to prevent the decreasing in the conveying ability of the conveying screw 33. In addition, because it becomes possible to prevent the waste toner from being accumulated on the blade edge portion, deterioration in the image quality due to a cleaning failure or an added agent passed through the cleaning blade can be prevented.

In addition, because the scraping pieces 53 are turned as the conveying screw 33 is rotated, they are successively turned in the conveying direction of the conveying screw 33. Accordingly, it becomes possible to enhance the waste toner conveying force.

In addition, the most upper portion of the spiral blade 49 is positioned above the contact portion where the cleaning blade 32 comes into contact with the photosensitive drum 15 so that it becomes possible to lower the height of the housing 31. That is, the cleaning device 17 can be made to be small in size so as to be capable of coping with a downsizing of the color printer 1.

In addition, the scraping piece 53 comes into contact with the conveying screw 33 in the forward direction to the rotating direction of the conveying screw 33. Accordingly, the scraping piece 53 is prevented from being wound by the conveying screw 33 so that it becomes possible to make the scraping pieces 53 come into contact with the conveying screw 33 stably.

Figure 5:
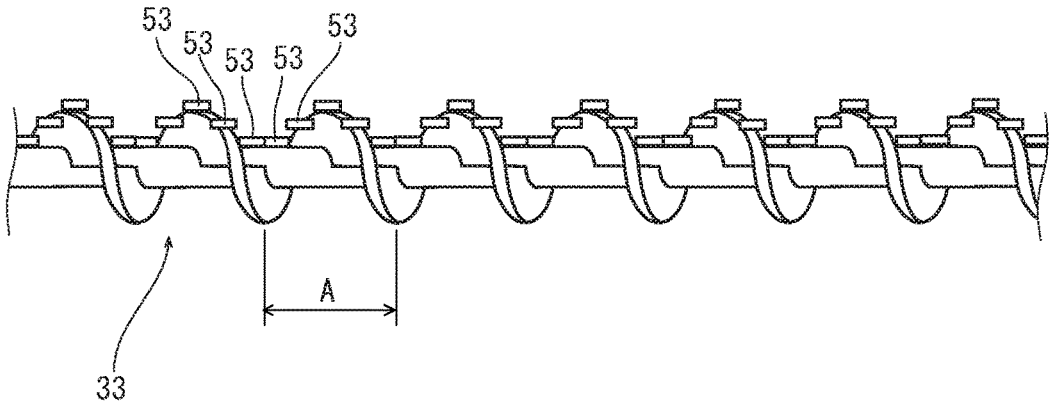
FIG. 5 is a view schematically showing a contact state where the scraping pieces of the scraping member of a second embodiment come into contact with the conveying screw, in the cleaning device according to the embodiment of the present disclosure.

Next, with reference to FIG. 5, the scraping member according a second embodiment will be described. FIG. 5 is a view schematically showing a contact portion where the scraping pieces come into contact with the conveying screw.

In the second embodiment, the scraping piece 53 has a width equal to ⅕ of the pitch A of the spiral blade 49. That is, the width of the scraping piece 53 is narrower than that of the scraping piece 53 of the first embodiment.

By making the width of the scraping piece 53 being narrower, as shown in FIG. 5, the scraping pieces 53 come into contact with the outer circumferential face of the rotating shaft 48 of the conveying screw 33 at finer intervals in the axis direction of the rotating shaft 48. In addition, a contact period where the scraping piece 53 comes into contact with the outer circumferential face becomes long. Accordingly, it becomes possible to prevent the adhesion of the waste toner on the rotating shaft 48 surely.

Figure 6:
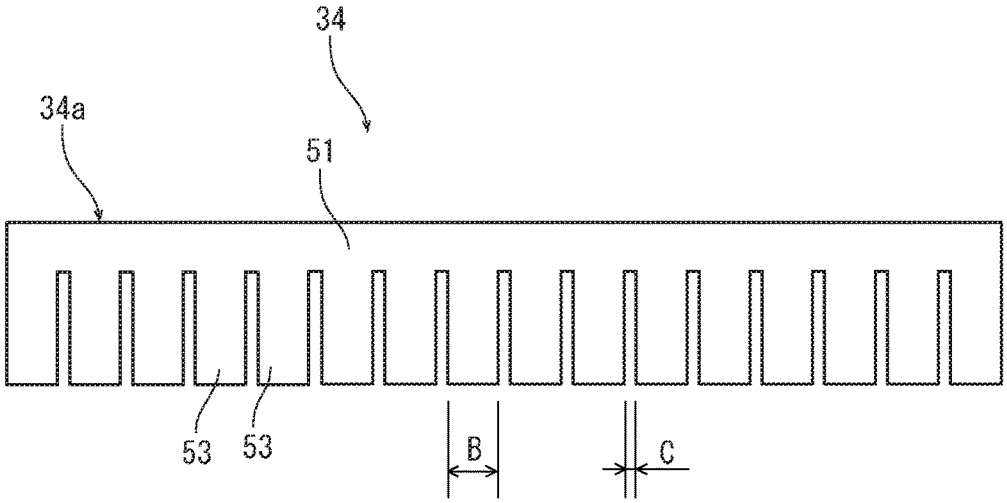
FIG. 6 is a plan view showing the sheet member from which the scraping member of a third embodiment is formed, in the cleaning device according to the embodiment of the present disclosure.

Next, with reference to FIG. 6, the scraping member according a third embodiment will be described. FIG. 6 is a plan view showing the sheet member.

In the third embodiment, a gap is formed between the adjacently arranged scraping pieces 53. An interval C of the gap is 0.5 mm, for example.

By forming the gap between the adjacently arranged scraping pieces 53, it becomes possible to prevent generate abnormal noise due to friction between the adjacently arranged scraping pieces 53. Accordingly, noise reduction can be achieved. The interval C is preferably 1.0 mm and below, more preferably 0.1 mm to 0.5 mm.

Figure 7:
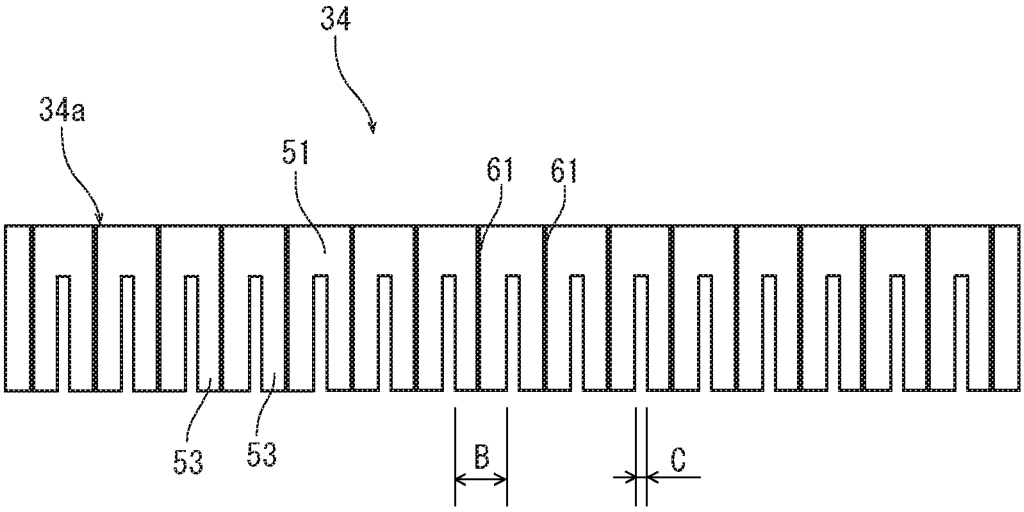
FIG. 7 is a plan view showing a sheet member from which the scraping member of a fourth embodiment is formed, in the cleaning device according to the embodiment of the present disclosure.

Next, with reference to FIG. 7, the scraping member according a fourth embodiment will be described. FIG. 7 is a plan view showing the sheet member.

In the fourth embodiment, the scraping pieces 53 each have an elastic member 61. The elastic member 61 is bonded to an opposing face to the contact face with the conveying screw 33. The elastic member 61 extends to the fixing part 51. The elastic member 61 is made of metal wire, for example. By bonding the elastic member 61 to the scraping piece 53, the elastic force of the scraping piece 53 is enhanced to improve a pressing force of the scraping piece 53 on the conveying screw 33. Accordingly, the scraping force for the waste toner can be more enhanced.

Figure 8:
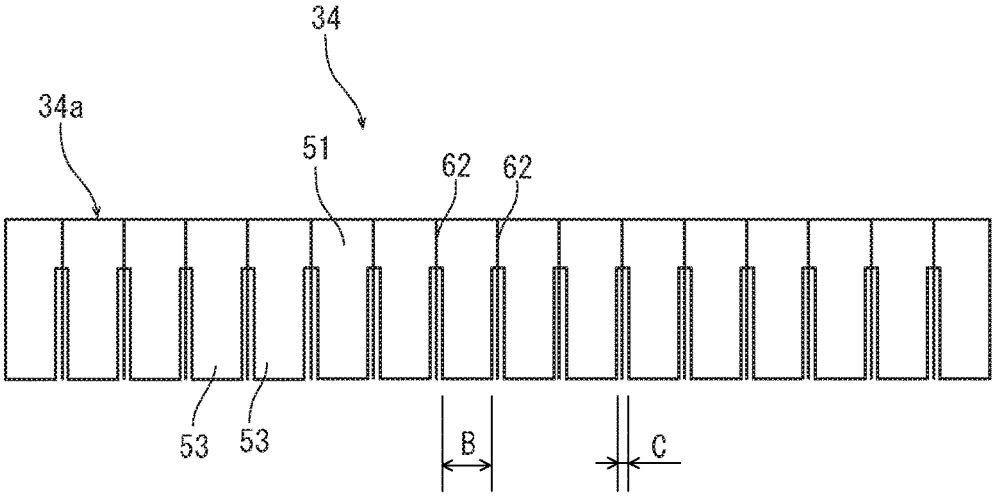
FIG. 8 is a plan view showing a sheet member from which the scraping member of a fifth embodiment is formed, in the cleaning device according to the embodiment of the present disclosure.

Next, with reference to FIG. 8, the scraping member according a fifth embodiment will be described. FIG. 8 is a plan view showing the sheet member.

In the fifth embodiment, a wire shaped elastic member 62 is bonded to the fixing part 51 so as to correspond to a gap between the adjacently arranged scraping pieces 53. The elastic member 62 extends through the gap between the adjacently arranged scraping pieces 53 to near a tip end of the scraping piece 53. The elastic member 62 is made of metal wire, for example. A number of the elastic member 62 may be one or more. By bonding the elastic member 62, the waste toner can be scraped by the elastic members 62 even at the gap between the adjacently arranged scraping pieces 53. Accordingly, it becomes possible to scrape the waste toner more finely in the axis direction of the rotating shaft 48 so that the scraping force of the scraping piece 53 can be enhanced.

In addition, by combining the configuration of the fourth embodiment with the configuration of the fifth embodiment, the scraping force can be more enhanced.

Figure 9:
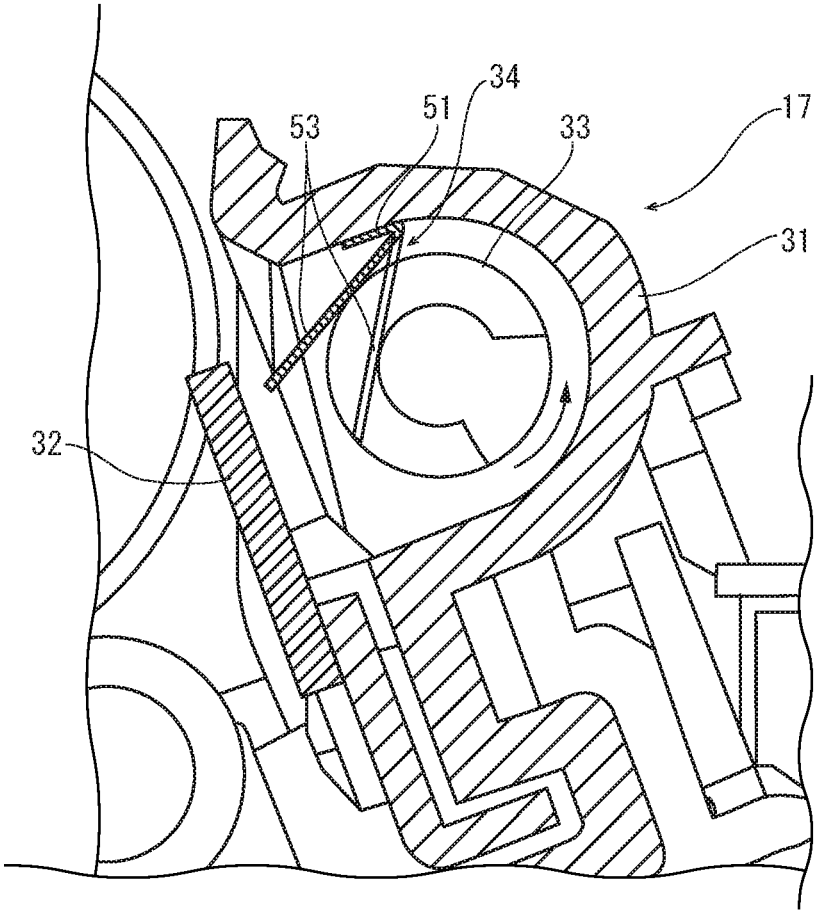
FIG. 9 is a sectional view showing the scraping member of a sixth embodiment attached to a housing, in the cleaning device according to the embodiment of the present disclosure.

Next, with reference to FIG. 9, the scraping member according a sixth embodiment will be described. FIG. 9 is a side sectional view showing the cleaning device.

In the sixth embodiment, the fixing part 51 of the scraping member 34 is supported by the housing 31 in a counter direction to the rotating direction (the counterclockwise direction in FIG. 7) of the conveying screw 33. The scraping pieces 53 are bent with respect to the fixing part 51 and come into contact with the conveying screw in the forward direction to the rotating direction.

By supporting the fixing part 51 to the housing 31 in the counter direction, the scraping piece 53 is elastically pressed against the conveying screw 33 so that the contact force of the scraping piece 53 to the conveying screw 33 can be heightened. Accordingly, the scraping force can be more enhanced.

Figure 10:
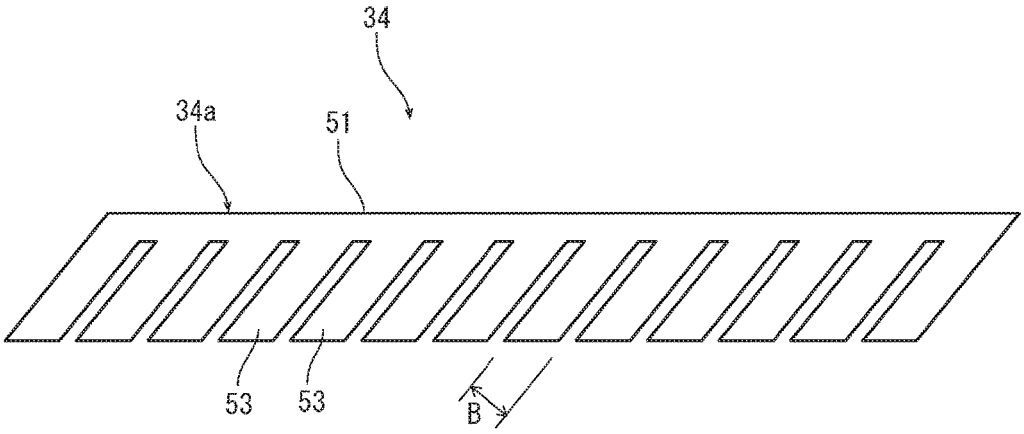
FIG. 10 is a plan view showing a sheet member from which the scraping member of a seventh embodiment is formed, in the cleaning device according to the embodiment of the present disclosure.

Next, with reference to FIG. 10, the scraping member according a seventh embodiment will be described. FIG. 10 is a plan view showing the sheet member.

In the seventh embodiment, the scraping pieces 53 are formed so as to be parallel to the spiral blade 49 of the conveying screw 33.

By making the scraping pieces 53 be parallel to the spiral blade 49, the scraping piece 53 comes into contact with a corner between the spiral blade 49 and the rotating shaft 48. Accordingly, it becomes possible to prevent the adhesion of the waste toner accumulated on the corner.

Next, an experimental example 1 will be described. In this experiment, a weight of the waste toner is measured for every number of printed sheets in the cleaning device shown in FIG. 2.

The cleaning device 17 shown in FIG. 2 is equipped with an experimental machine (ECOCYS M5526cdw, made by KYOCERA Document Solutions). Then, a weight of the waste toner in the drum unit 10 is measured for every predetermined numbers of printed sheets.

In the cleaning device 17, the interval A of the pitch of the spiral blade 49 of the conveying screw 33 is 10 mm. A width of the scraping piece 53 and an interval C of the gap between the adjacently arranged scraping pieces 53 are described below.

EXAMPLE 1

A width B of the scraping piece 53: 3 mm (≤A/2=10/2),
An interval C of the gap between the adjacently arranged scraping pieces 53: 0.5 mm.

EXAMPLE 2

A width B of the scraping piece 53: 1 mm (≤A/2=10/2),
An interval C of the gap between the adjacently arranged scraping pieces 53: 0.5 mm.

COMPARATIVE EXAMPLE 1

No scraping member 34.

COMPARATIVE EXAMPLE 2

A width B of the scraping piece 53: 6 mm (>A/2=10/2),
An interval C of the gap between the adjacently arranged scraping pieces 53: 0.5 mm.

Figure 11:
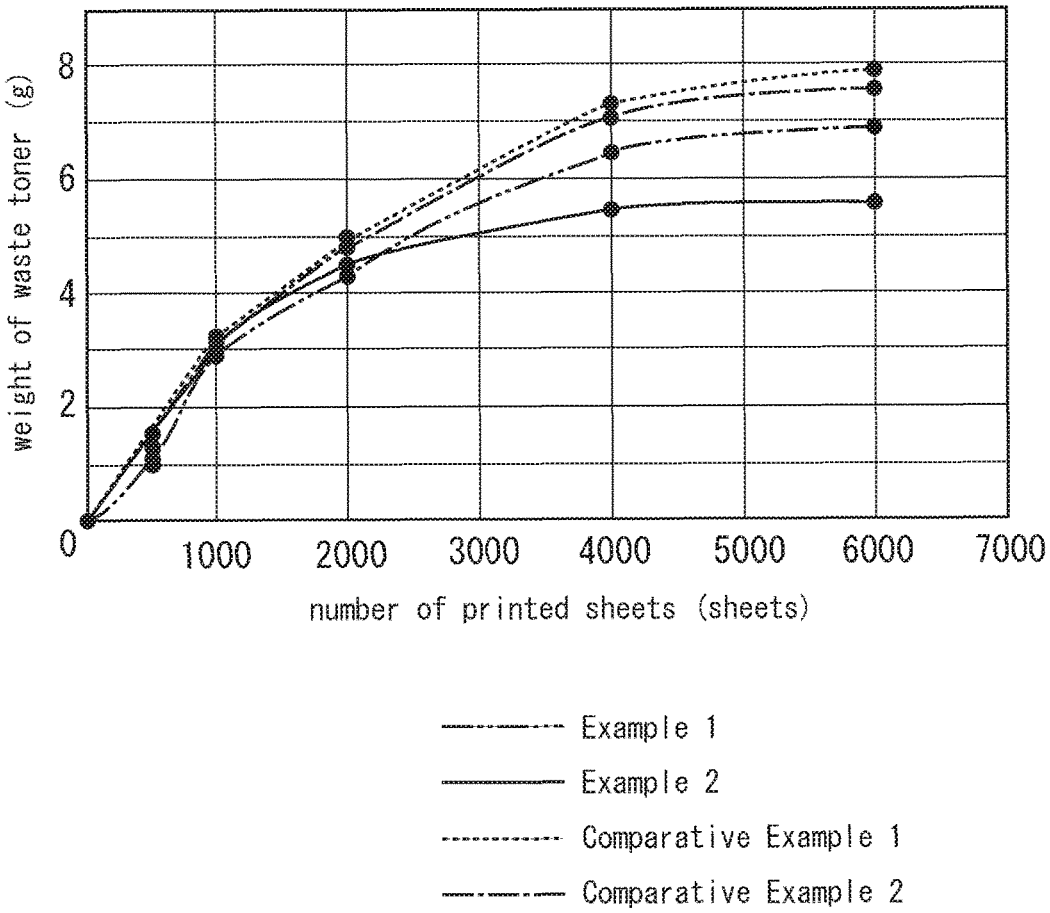
FIG. 11 is a graph showing a relationship between a weight of a waste toner and a number of printed sheets when a width of the scraping piece is varied, in the cleaning device according to the embodiment of the present disclosure.

FIG. 11 is a graph showing a relationship between the number of printed sheets and the weight of the waste toner in Example 1, Example 2, Comparative Example 1 and Comparative Example 2. A vertical axis of the graph shows the weight of the waste toner (g) and a horizontal axis shows the number (sheet) of the printed sheets. A two dotted chain line shows Example 1, a solid line shows Example 2, a broken line shows Comparative Example 1 and a chain line shows Comparative Example 2.

As shown in the graph, in each Example, the weight of the waste toner is increased until the number of printed sheets reaches about 2000 in the almost same way. Comparative Example 1 having no scraping member 34 shows that the weight of the waste toner is increased to about 8 g when the number of printed sheets reaches 6000. Comparative Example 2 of which the width B of the scraping piece 53 is 6 mm (>A/2) shows that the weight of the waste toner is increased to about 7.8 g when the number of printed sheets reaches 6000.

On the other hand, when the number of printed sheets reaches 6000, Example 1 shows that the weight of the waste toner is increased to about 6.5 g and Example 2 shows that the weight of the waste toner is increased to about 4.5 g. These values are smaller than Comparative Examples 1 and 2. This shows that the weight of the waste toner discharged from the drum unit is larger in Examples 1 and 2 than in Comparative Examples 1 and 2. In other words, Examples 1 and 2 has a waste toner collecting ability larger than Comparative Examples 1 and 2. This also shows that even if the scraping member 34 is provided, in a case where the width B of the scraping piece 53 is larger than A/2 (B>A/2) like Comparative Example 2, an effect for preventing the decreasing in the waste toner conveying ability is not obtained. This is because in a case where the width B of the scraping piece 53 is larger than A/2 (B>A/2), it is impossible to prevent the increasing in the diameter of the rotating shaft 48 of the conveying screw 33. As a result, a turning range of the scraping pieces 53 becomes narrow and thus an effect for crushing the lump of the waste toner accumulated on the rotating shaft 48 cannot be obtained.

Especially, Example 2 shows a better result than Example 1. This shows that as the width of the scraping piece 53 becomes narrower, the adhesion of the waste toner to the rotating shaft 48 of the conveying screw 33 can be prevented so that the waste toner collecting ability can be increased. In the experimental result, Example 2 shows that the weight of the waste toner can be decreased by about 40% compared with Comparative Examples 1 and 2.

Next, an experimental example 2 will be described. In this experiment, a weight of the waste toner is measured for every number of printed sheets using the same experimental machine as the experimental example 1.

In the cleaning device 17, an interval A of the pitch of the spiral blades 49 of the conveying screw 33 is 10 mm. A width B of the scraping piece 53 and an interval C of the gap between the adjacently arranged scraping pieces 53 are described below.

EXAMPLE 1

A width B of the scraping piece 53: 1 mm (≤A/2=10/2),
An interval C of the gap between the adjacently arranged scraping pieces 53: 1.5 mm.

EXAMPLE 2

A width B of the scraping piece 53: 1 mm (≤A/2=10/2),
An interval C of the gap between the adjacently arranged scraping pieces 53: 1.0 mm.

EXAMPLE 3

A width B of the scraping piece 53: 1 mm (≤A/2=10/2),
An interval C of the gap between the adjacently arranged scraping pieces 53: 0.5 mm.

COMPARATIVE EXAMPLE 1

No scraping member 34.

Figure 12:
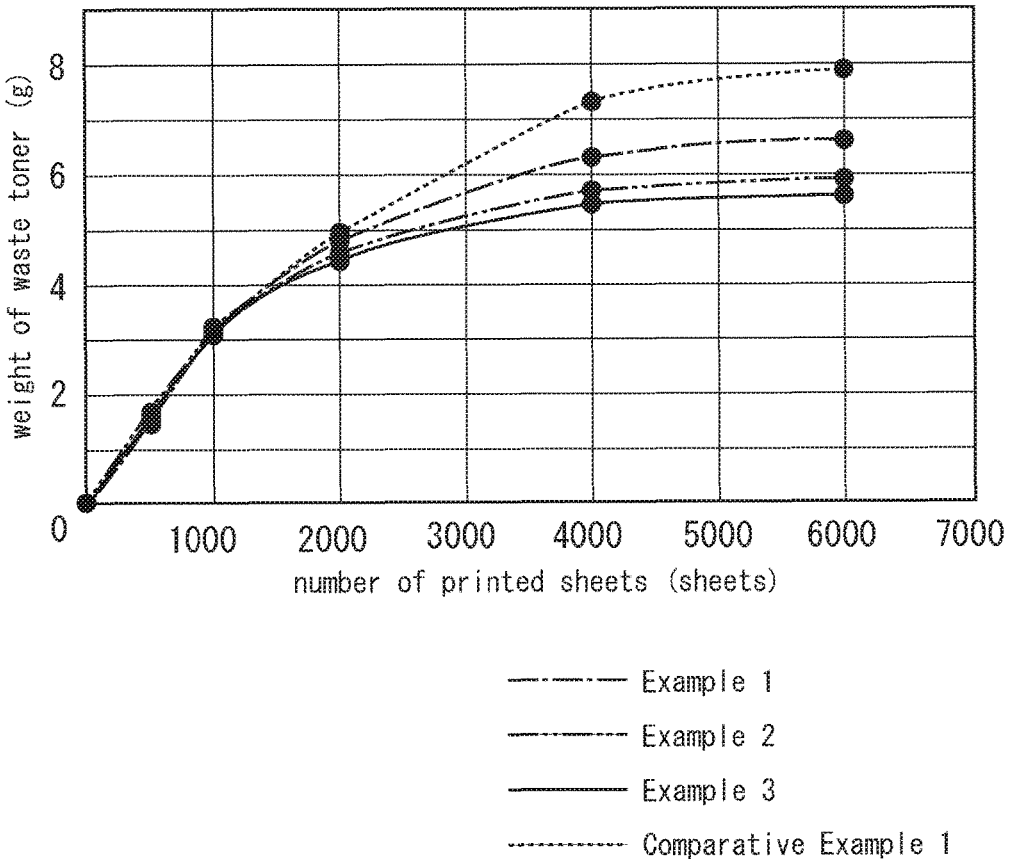
FIG. 12 is a graph showing a relationship between a weight of a waste toner and a number of printed sheets when a width of a gap between the adjacent arranged scraping pieces is varied, in the cleaning device according to the embodiment of the present disclosure.

FIG. 12 is a graph showing a relationship between the weight of the waste toner and the number of printed sheets in Example 1, Example 2, Example 1 and Comparative Example 1. A vertical axis of the graph shows the weight of the waste toner (g) and a horizontal axis shows the number (sheet) of the printed sheets. A chain line shows Example 1, a two dotted chain line shows Example 2, a solid line shows Example 3 and a broken line shows Comparative Example 1.

As shown in the graph, in each Example, the weight of the waste toner is increased until the number of printed sheets reaches about 2000 in the almost same way. Comparative Example 1 having no scraping member 34 shows that the weight is increased to about 8 g when the number of printed sheets reaches 6000.

Example 1 in which the gap C between the adjacently arranged scraping pieces 53 is 1.5 mm shows that the weight of the waste toner is increased to about 6.6 g when the number of printed sheets reaches 6000. On the other hand, Example 2 in which the gap C between the adjacently arranged scraping pieces 53 is 1.0 mm and Example 3 in which the gap C between the adjacently arranged scraping pieces 53 is 0.5 mm show that the weight of the waste toner is increased to about 5.9 g and about 5.6 g respectively when the number of printed sheets reaches 6000.

As described above, as the gap C becomes wider, the weight of the waste toner is increased, that is, the waste toner conveying ability is decreased. This is because when the waste toner is conveyed in the rotating direction of the conveying screw 33, the waste toner reaches the blade edge portion through the gap between the adjacently arranged scraping pieces 53 and is accumulated on the blade edge portion.

Therefore, it is better as the gap C is narrower. However, if the weight of the waste toner is 6 g or below when the number of printed sheets reaches 6000, it is allowable for cleaning failure and passing through of the added agent. Accordingly, the gap C equal to or below 1.0 mm can provide an effect for preventing the decreasing in the waste toner conveying ability.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

In the above description, the first embodiment has a configuration in which the image forming part 4 is detachably attached to the apparatus main body 2. However, the present disclosure may be applied to another configuration. For example, each combination of the drum unit 10 provided for every toner of at least four colors (Y, M, C and K) and the cleaning device 17 is set as an image forming unit 100 and the image forming unit 100 may be detachably attached to the apparatus main body 2.

The invention claimed is:

1. A cleaning device comprising:

a conveying member having a rotating shaft and a spiral blade formed around the rotating shaft and configured to be rotated around an axis to convey a toner removed from an image carrier in a direction of the axis; and a plurality of scraping pieces arranged in the direction of the axis and configured to be turnable so as to alternately come into contact with the rotating shaft and the spiral blade to scrape the toner adhered on the rotating shaft, wherein a width of the scraping piece in the direction of the axis is equal to or below ½ of a gap between a pitch of the spiral blade in the direction of the axis, and the plurality of scraping pieces are arranged in the direction of the axis without a gap between the adjacently arranged scraping pieces.

2. The cleaning device according to claim 1 comprising a housing to which the plurality of scraping pieces are supported, wherein the plurality of scraping pieces each have a fixing part which is supported to the housing in a counter direction to a rotating direction of the conveying member, and the plurality of scraping pieces are bent with respect to the fixing part in a forward direction to the rotating direction.

3. A cleaning device comprising:

a conveying member having a rotating shaft and a spiral blade formed around the rotating shaft and configured to be rotated around an axis to convey a toner removed from an image carrier in a direction of the axis; and a plurality of scraping pieces arranged in the direction of the axis and configured to be turnable so as to alternately come into contact with the rotating shaft and the spiral blade to scrape the toner adhered on the rotating shaft, wherein a width of the scraping piece in the direction of the axis is equal to or below ½ of a gap between a pitch of the spiral blade in the direction of the axis, the plurality of scraping pieces are arranged in the direction of the axis with a gap between the adjacent arranged scraping pieces, and the gap is equal to or below 1.0 mm.

4. The cleaning device according to claim 3, comprising a housing to which the plurality of scraping pieces are supported, wherein the plurality of scraping pieces each have a fixing part which is supported to the housing in a counter direction to a rotating direction of the conveying member, and the plurality of scraping pieces are bent with respect to the fixing part in a forward direction to the rotating direction.

* * * * *